US010907798B2

(12) United States Patent
Strelchuk

(10) Patent No.: US 10,907,798 B2
(45) Date of Patent: Feb. 2, 2021

(54) SYSTEM AND METHOD FOR ADJUSTING BEAM SIZE WHILE MAINTAINING BEAM BRIGHTNESS

(71) Applicant: THE KIRLIN COMPANY, Detroit, MI (US)

(72) Inventor: Joseph Strelchuk, Clarkston, MI (US)

(73) Assignee: THE KIRLIN COMPANY, Detroit, MI (US)

( * ) Notice: Subject to any disclaimer, the term of this patent is extended or adjusted under 35 U.S.C. 154(b) by 0 days.

(21) Appl. No.: 16/440,380

(22) Filed: Jun. 13, 2019

(65) Prior Publication Data

US 2020/0393111 A1 Dec. 17, 2020

(51) Int. Cl.

| | |
|---|---|
| ***F21V 14/06*** | (2006.01) |
| *F21W 131/20* | (2006.01) |
| *F21S 41/63* | (2018.01) |

(52) U.S. Cl.

CPC ..... *F21V 14/06* (2013.01); *F21S 41/635* (2018.01); *F21W 2131/20* (2013.01)

(58) Field of Classification Search

None

See application file for complete search history.

(56) References Cited

U.S. PATENT DOCUMENTS 5,526,245 A 6/1996 Davis et al.
2010/0165628 A1* 7/2010 Davydov ..... F21S 41/143 362/268
2015/0138787 A1* 5/2015 Wu ..... F21S 41/635 362/466
2016/0290583 A1* 10/2016 Suwa ..... F21S 41/43
2017/0108200 A1* 4/2017 Venturati ..... F16H 25/2015
2018/0051857 A1* 2/2018 Yamada ..... F21S 41/25
2019/0360665 A1* 11/2019 Latteo ..... G03B 21/145

OTHER PUBLICATIONS

Website: Skytron, LLC.—Specialty Lights, www.skytron.us/products/pages/specialty.html, Copyright Skytron 2017, retrieved on Apr. 24, 2017, 1 page.

Website: Skytron, LLC.—Lucina 4, www.skytron.us/products/pages/lucina4.html, Copyright Skytron 2017,retrieved on Apr. 24, 2017, 1 page.

(Continued)

*Primary Examiner* — Kurtis R Bahr

(74) *Attorney, Agent, or Firm* — Brooks Kushman P.C.

(57) ABSTRACT

A method for generating a beam of light that impinges on a target, wherein beam intensity remains substantially constant regardless of beam spot size. The method involves: providing a light source, a lens that can be moved to or between various positions, a slide having positions at which the lens may be supported, a target at which a beam is directed and a controller that communicates between an optical position feedback encoder and the light source; linking the encoder and the lens, the encoder sending a lens position signal to the controller, including an encoder translator circuit which communicates with a microprocessor that receives user inputs which characterize desired beam size at the target; generating a light source power signal to the light source so that electrical power delivered by the light source changes in response to the position of the lens.

13 Claims, 7 Drawing Sheets

MEDIUM SPOT

(56) References Cited

OTHER PUBLICATIONS

MAQUET Medical Systems USA, PowerLED: The 2nd Second Generation is Here!, Copyright MAQUET SAS, Ardon, Printed in USA Jan. 2013, 12 pages.
The Kirlin Company, OPTeMED 1 Light System 360—MRR-12642, Aug. 2018, 4 pages.
The Kirlin Company, INFRALED® 60 Lighting in Birthing Suites, Oct. 2015, 2 pages.
MASCOT, Grand Mecure Beam Angle Changeable Track Light—30W-ML-TL012, 1 page.
Lensvector, Products, Copyright 2018 LensVector, 2 pages.
KLM Led Lighting, Museum Zoom LED Track Light, Copyright 2008-2020, 7 pages.
ALIGHT, Special design COB LED track lighting with adjusting beam angle, Sep. 27, 2016, 2 pages.

* cited by examiner

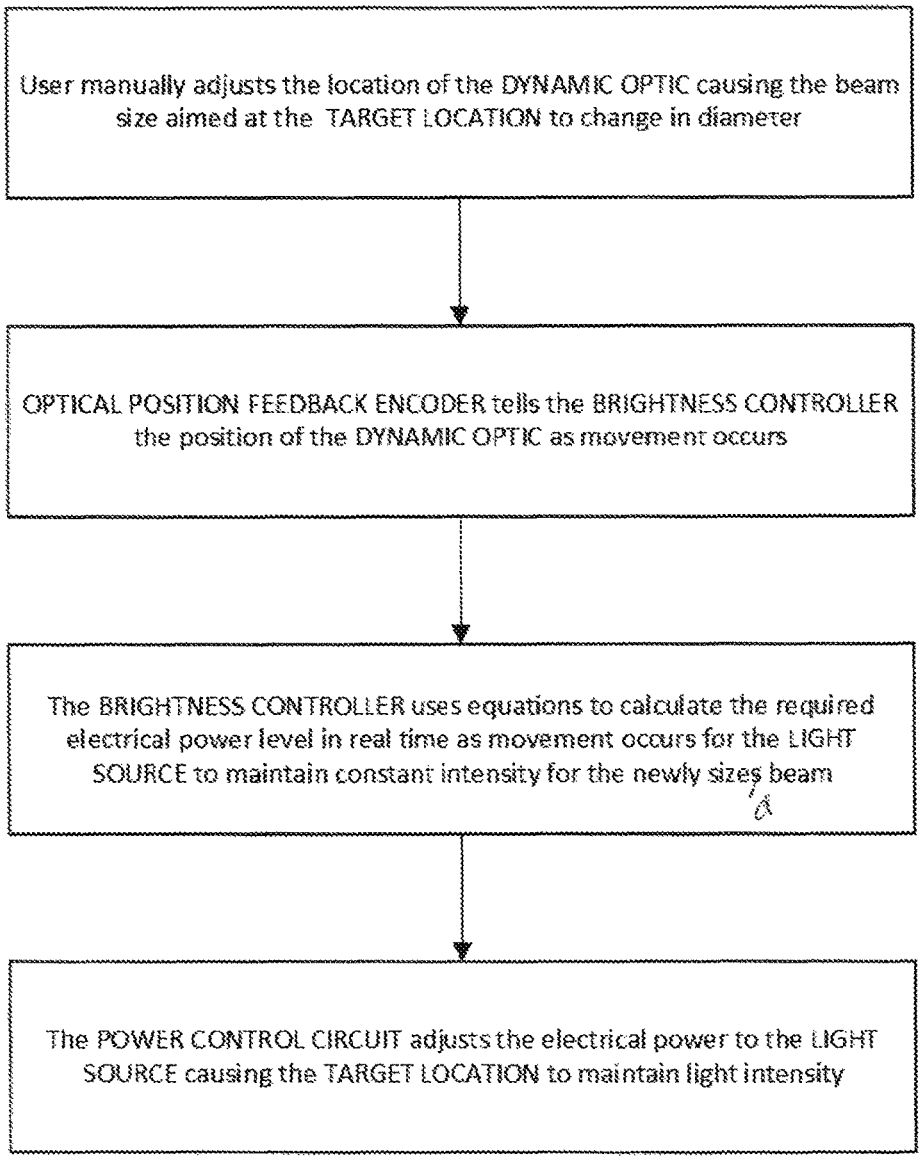
FIGURE 1: EXAMPLE FLOW CHART FOR MANUALLY ADJUSTED POSITION OF DYNAMIC OPTIC

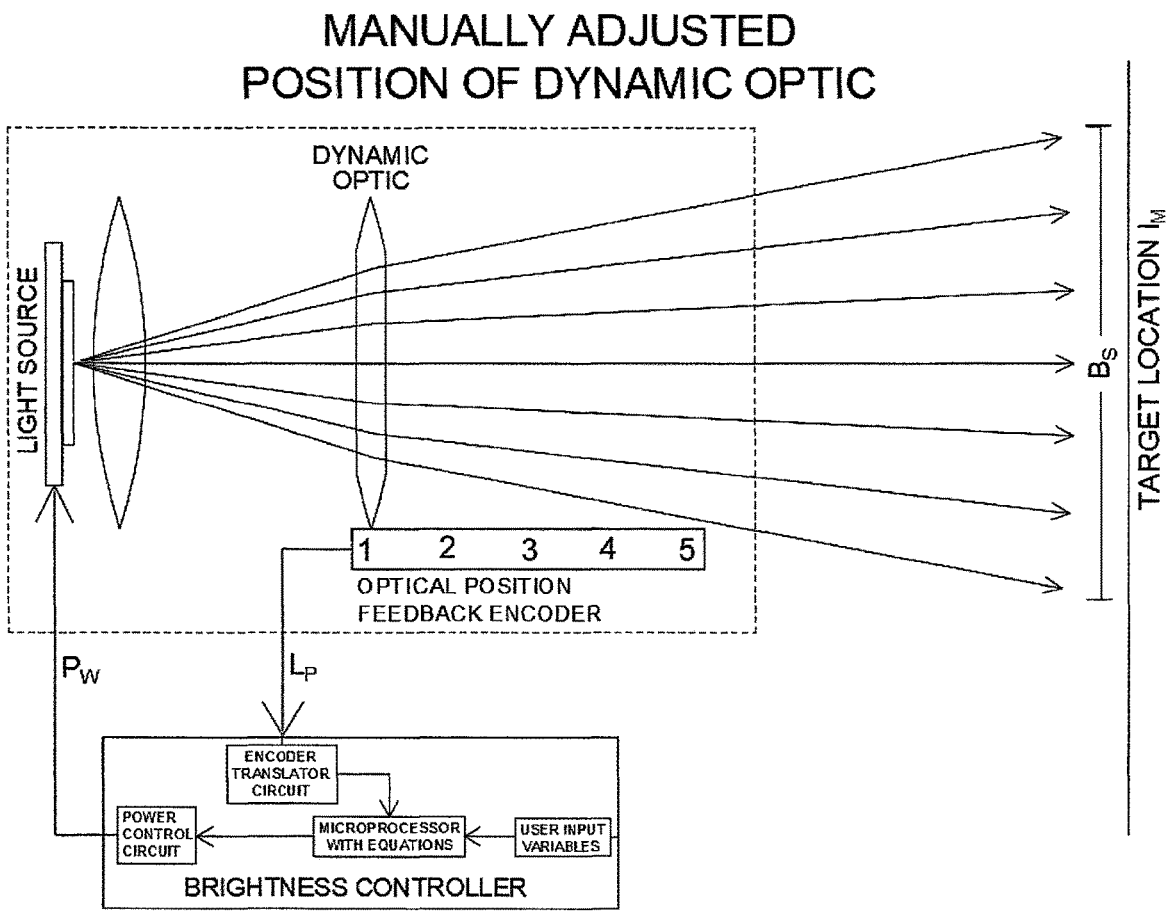
FIGURE 2: LARGE SPOT: Intensity is adjusted as the dynamic optic location is moved and the diameter of the spot changes. This is accomplished by the brightness controller changing the electrical power level to the light source based on the optical position feedback encoder.

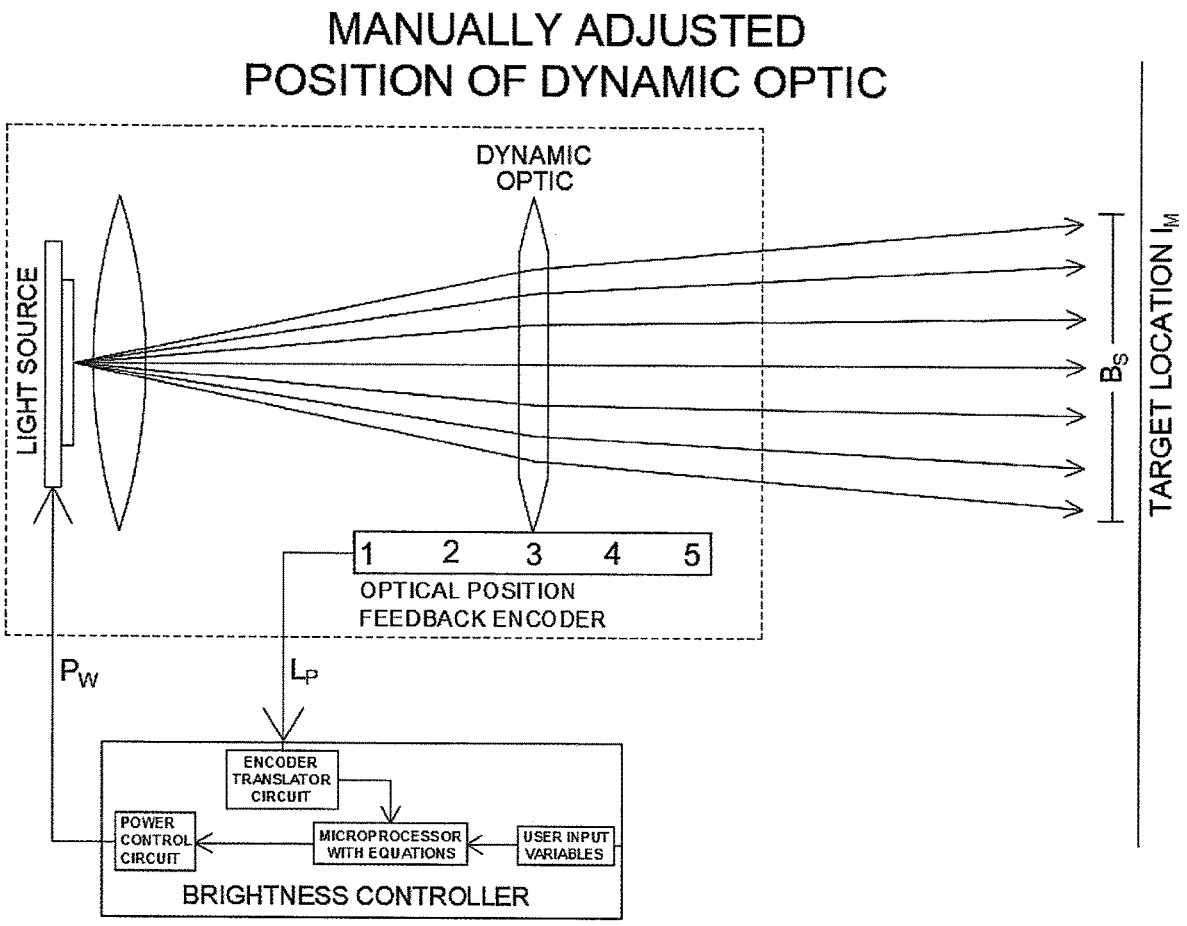
FIGURE 3: MEDIUM SPOT

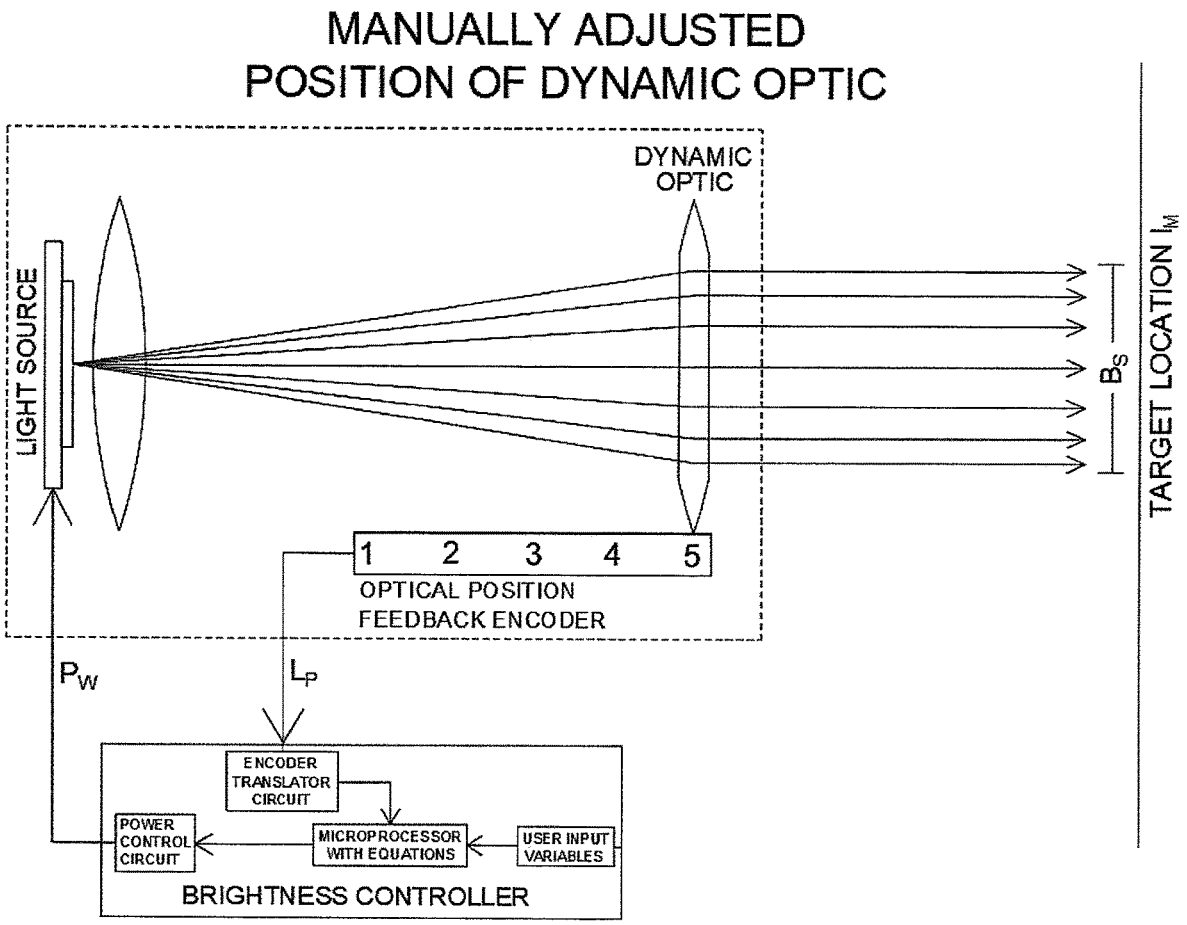
FIGURE 4: SMALL SPOT

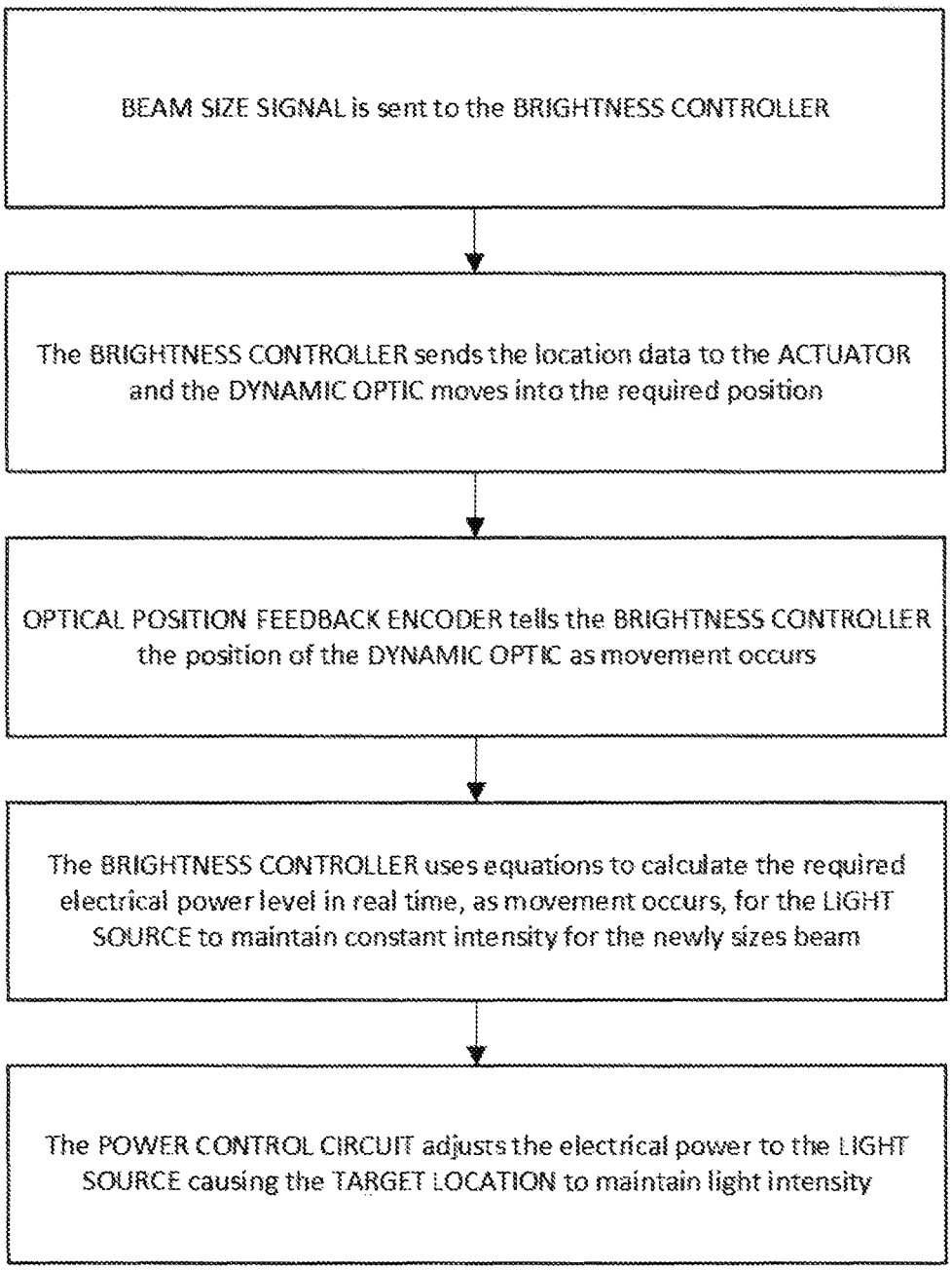
FIGURE 5: EXAMPLE FLOW CHART FOR ELECTROMECHANICAL ADJUSTED POSITION OF DYNAMIC OPTIC

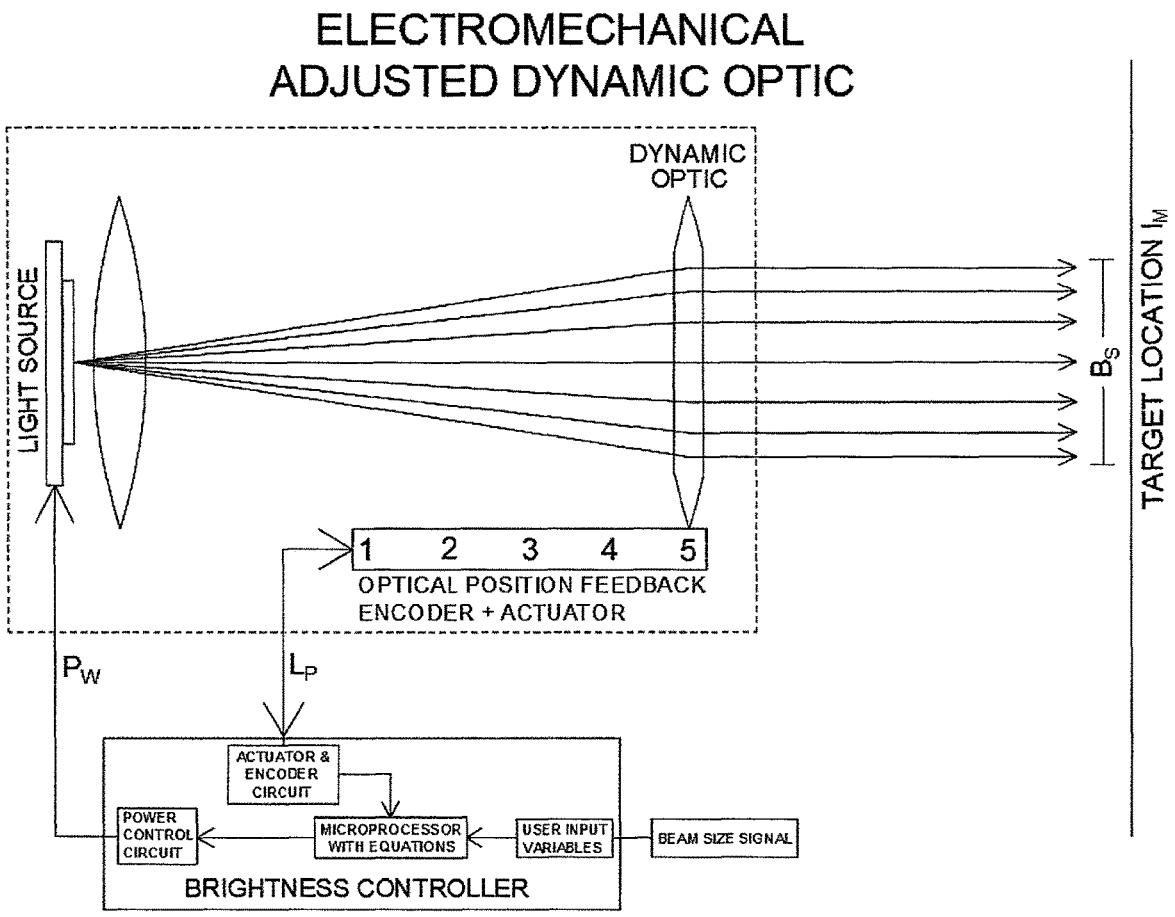
FIGURE 6: SMALL SPOT: intensity is adjusted automatically as the beam size is changed per the users input signal. The dynamic optic location is moved to the proper position by the actuator. This is accomplished by the brightness controller changing the electrical power level to the light source based on the optical position feedback encoder.

| LENS POSITION $L_P$ | BEAM SIZE $B_S$ (DIAMETER IN INCHES) | INTENSITY $I_M$ (FOOT CANDLES) | ELECTRICAL POWER $P_W$ (WATTS) |
|---|---|---|---|
| 5 | 6 | 50 | 2.08 |
| 4 | 12 | 50 | 8.33 |
| 3 | 18 | 50 | 18.75 |
| 2 | 24 | 50 | 33.33 |
| 1 | 36 | 50 | 75.00 |

FIGURE 7: EXAMPLE OF VARIOUS POSITIONS AND BRIGHTNESS CONTROLLER VARIABLE.

SYSTEM AND METHOD FOR ADJUSTING BEAM SIZE WHILE MAINTAINING BEAM BRIGHTNESS

TECHNICAL FIELD

This disclosure relates to an illumination system in which the size of light beams that impinge on a target can be altered without changing beam brightness or intensity.

BACKGROUND

In several environments of use, such as but not limited to doctor's examining room or an operating theater in a hospital, it would be desirable for an operator to adjust beam size or diameter while maintaining intensity across the beam size adjustment range.

SUMMARY

Several alternative embodiments include a system for generating a beam of light that impinges on a target, wherein beam intensity remains substantially constant regardless of beam spot size. In some cases, the system comprises a light source, one or more optical control devices such as dynamic optics or lenses, an optical position feedback encoder and a brightness control circuit.

One way to use such a system involves a method for generating a beam of light that impinges on a target, so that beam intensity remains substantially constant regardless of beam spot size. The method includes these steps:

1. providing a light source, a movable lens, a lens positioning device such as a slide having multiple positions at which the lens may be supported, a target at which a beam is directed and a controller that communicates between the lens positioning device and the light source;
2. mounting an optical position feedback encoder in coordination with the lens, the encoder sending a signal to the controller, the signal reporting the position of the lens required to pass a light beam of a desired size to a target location;
3. including in the controller an encoder translator circuit which communicates with a microprocessor on which one or more equations are executed, the microprocessor also being configured to receive user inputs that characterize beam size at the target; and
4. generating a light source power signal in the microprocessor that is delivered to a power control circuit that is associated with the light source so that electrical power delivered by the light source changes in response to the position of the dynamic optic in order to generate a desired size of light beam that has a substantially constant intensity, regardless of the size of the beam that is directed at the target location.

BRIEF DESCRIPTION OF THE DRAWINGS

FIG. 1 is a flow chart that sets forth some steps involved in adjusting the power of a light source to produce a beam of substantially constant intensity as lens location is manually moved and the diameter of the beam spot at a target changes. This is accomplished by a brightness controller creating the power adjustment based on the optical position feedback.

FIG. 2 schematically shows a system layout in which a lens is located at a first position to produce a beam at the target location of a given size ("large spot") and desired intensity with the assistance of an optical position feedback encoder and a brightness controller.

FIG. 3 schematically shows a system layout in which a lens is manually located at another position, coupled with the optical position feedback encoder and brightness controller to produce a beam ("medium spot") at the target location of substantially the same intensity as when the lens is in the first position.

FIG. 4 schematically shows a system layout in which a lens is manually located at yet another position, coupled with the optical position feedback encoder and brightness controller to produce a beam ("small spot") at the target location of substantially the same intensity as when the lens is in other positions (e.g. those shown in FIGS. 2-3).

FIG. 5 is a flow chart that sets forth some steps involved in adjusting the power of a light source to produce a beam of substantially constant intensity as a lens location is electro-mechanically moved by an actuator and the diameter of the spot changes.

FIG. 6 schematically shows a system layout in which a lens is electromechanically positioned, coupled with the optical position feedback encoder and the actuator with the brightness controller to produce a beam ("small spot") at the target location of substantially the same intensity as when the lens in other positions.

FIG. 7 is a table of illustrative beam sizes and electrical power required to produce beams of a given intensity, independently of beam size.

DETAILED DESCRIPTION

As required, detailed embodiments of the present invention are disclosed herein; however, it is to be understood that the disclosed embodiments are merely exemplary of the invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It will be appreciated that in many conventional environments, a light source does not change its emitted brightness as beam diameter changes following lens re-positioning. This generally causes the spot's intensity at a target location to increase as beam diameter becomes smaller. One consequence may be unwanted heat generation, particularly over time.

Consider a beam of light that impinges on a target. One aim of this disclosure is to provide a system and method for changing the size of a spot of light projected at a target (e.g., by beam angle adjustment or re-positioning a lens) while maintaining beam intensity throughout the entire range of spot size adjustment.

One way to practice the disclosed system and method is depicted in the flowchart of FIG. 1 and the system schematics of FIGS. 2-4 (manual lens re-positioning).

In several embodiments (e.g. FIGS. 1-4), the disclosed illumination system includes a light source, one or more optical control devices such as dynamic optics or lenses, an optical position feedback encoder and a brightness control circuit (sometimes referred to herein as "controller").

One way to use the disclosed illumination system (see, e.g., FIG. 1) calls for an operator to manually position a lens. In such cases, an optical position feedback subsystem will inform the brightness control circuit of the position of the lens. The control circuit will then adjust beam brightness by reference to an algorithm which is executed on a microprocessor associated with the control circuit.

In another embodiment (see, FIGS. 5-6), the location of the dynamic optic is moved electro-mechanically to a desired position by an actuator. Sometimes the actuator repositions the lens to produce a desired spot size as a result of an instruction(s) supplied by an operator, perhaps using a push button or sliding bar. Intensity adjustment is accomplished by the brightness controller changing the electrical power level that is delivered to the light source based on a signal from the optical position feedback encoder.

In practice, a user first manually adjusts the location of a dynamic optic or lens. This step may be accomplished by for example, mounting the dynamic optic on a slide feature along which the dynamic optic may selectively be positioned. In FIG. 2, exemplary positions 1-5 are shown. It will be appreciated that such positioning may be discrete or be continuous. Repositioning of the dynamic optic so that it is displaced further away from the light source causes the beam size aimed at a target to shrink in diameter (see, FIGS. 2-4).

An optical position feedback encoder sends a position signal to the brightness controller circuit. The position signal reports the location of the lens. In one embodiment, the brightness control circuit includes an encoder translator circuit which communicates with a microprocessor on which one or more equations are executed. The microprocessor also receives user inputs (such as desired beam size) that characterize variables associated with the particular application. Outputs from the microprocessor include power signals that are delivered to a power control circuit. In turn, that circuit communicates with the light source so that electrical power delivered to the light source changes in response to the position of the dynamic optic in order to generate a light beam that has a substantially constant intensity, regardless of the size of the beam that is directed at the target location.

Thus, the power control circuit adjusts the electrical power delivered to the light source. This causes the target location to receive a constant intensity of the incident light beam, regardless of beam diameter.

As mentioned, the brightness controller includes a microprocessor that uses one or more equations (to be discussed later) to calculate the required electrical power level, preferably in real time as lens movement occurs for the light source to maintain a constant intensity of the newly sized beam.

In some cases (e.g., FIGS. 5-6), an electromechanically-driven optic positioner may be deployed that communicates with a brightness control circuit. In such cases, a dynamic optic (see position 5, FIG. 6) has its position sensed by an optical position feedback encoder. An actuator displaces the dynamic optic as desired to produce a beam of a desired size at the target location. A signal ($L_P$) is communicated to the brightness controller circuit. In that circuit, an actuator and encoder receive the signal ($L_P$). An output from that circuit is communicated to a microprocessor on which one or more equations are executed.

A beam size signal ($B_s$) is communicated via user input variables (e.g. desired beam size) to the brightness controller circuit and in turn to the microprocessor. One output is an instruction that is relayed to the power control circuit. In turn, that circuit communicates a signal ($P_W$) which signifies a desired power level that is delivered to the light source.

That signal ($P_W$) informs the light source so that a predetermined power output is delivered by a power pack to the light source. That power level causes a beam to be generated that passes through the dynamic optic to the target. There, beam intensity is substantially constant, regardless of beam size.

One way to practice this embodiment of the disclosed illumination system calls for the operator to provide electromechanical lens adjustment inputs via buttons, for example on a control pad. This step positions the optics through the dynamic optical positioner (FIG. 6). As the spot size is changed, the brightness and dynamic optic control circuit adjusts beam brightness by reference to an algorithm.

Consider the flowchart of FIG. 5. Illustrative steps include the following.

A desired beam size signal ($B_S$) is provided to the brightness controller (e.g. by user input). Then, the dynamic optic actuator moves the lens into the required position. Next, an optical position feedback encoder informs the brightness controller about the position of the dynamic optic as movement occurs, or after movement ends. Subsequently, the microprocessor of the brightness controller uses an algorithm to calculate the required electrical power. This calculation is made in real time so that the light source maintains a substantially constant intensity over the area of a newly sized beam. In the brightness controller, the power control circuit adjusts the electrical power that is delivered to the light source. This causes the beam at the target location to maintain a constant light intensity over a range of beam sizes.

In one set of experiments, the following exemplary observations were made of lens position, beam size, and electrical power required to produce beams of a substantially constant intensity:

| LENS POSITION $L_P$ | BEAM SIZE $B_S$ (DIAMETER IN INCHES) | INTENSITY $I_M$ (FOOT CANDLES) | ELECTRICAL POWER $P_W$ (WATTS) |
|---|---|---|---|
| 5 | 6 | 50 | 2.08 |
| 4 | 12 | 50 | 8.33 |
| 3 | 18 | 50 | 18.75 |
| 2 | 24 | 50 | 33.33 |
| 1 | 36 | 50 | 75.00 |

Thus, several embodiments of the disclosed illumination system uniquely allow brightness to be maintained by:

(1) observing the size of the beam spot;

(2) providing feedback of beam size to a control circuit;

(3) computing an amount of light source power intensity adjustment required to maintain actual beam intensity as beam size changes; and optionally (4) processing an operator input to change beam size.

Consider further the exemplary embodiments of FIGS. 2-4. An operator manually adjusts lens position to produce a beam of a desired size. Lens position is observed by an optical position feedback device. In FIG. 6, the dynamic lens is displaced by electro-mechanical means. In each case, the dynamic optic (or lens) optical position feedback encoder senses the position of the dynamic optic and generates a signal ($L_p$) that signifies the position of the dynamic optic. The position of the dynamic optic is determined for example in relation to positions 1-5, either discretely or in intermediate positions.

That signal ($L_p$) is transmitted wirelessly or by cable to the brightness control circuit (FIGS. 2-4) or the brightness and dynamic control circuit (FIG. 6) (collectively, "controller").

The distance between the dynamic lens and the light source influences the size of the spot ($B_s$). The controller then generates a voltage or current (collectively, "power") signal $P_W$ and transmits it to the light source. In one embodiment, the light source includes one or more LED's, halogen bulbs, or the like. That signal adjusts the output of the light source to maintain the desired uniform brightness regardless of spot size ($B_S$).

It will be appreciated that the controller includes an analog or digital encoder. Representative encoders are described for example at encoder.com/blog/company-news/what-is-an-encoder, which is incorporated by reference. The encoder communicates with a microprocessor (see, e.g., www.microchip.com, which is incorporated by reference) that executes software which processes an algorithm or one or more equations. Variables considered by the algorithm include specifications of the optics, LEDs, and LED driver(s) used. Typical lens types include those available from LEDil (www.ledil.com) and Khatod (www.khatod.com). The contents of those websites are incorporated by reference.

A representative equation for computing the power of light source to produce a given beam size is:

$$P = \frac{(\pi * r^2)}{(\pi * m^2)} * w * o * s * t,$$

where
P=electrical power
r=radius of desired beam size
m=radius of maximum beam size
w=power at maximum beam diameter
o=optical efficiency variable
s=source efficiency variable
t=temperature coefficient variable.

The output signal ($P_W$) from the circuit is delivered to the light source. The signal is a function of amperage, voltage or power. As a consequence, the light source is adjusted to shine brightly, dimly or at an intensity therebetween in order to produce a desired intensity of beam at the target, regardless of beam size.

Optionally a static lens or optic may be provided that serves as a collimator. A reflector may optionally be provided as an adjunct to any of the lenses disclosed.

In use, the lens, controller circuit and light source are often packaged together. Optionally, the controller circuit may be positioned remotely from the light source.

If desired one or more cooling subsystems (e.g., an aluminum heat sink or a liquid-cooled feature) may be deployed in relation to the light source.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for generating a beam of light that impinges on a target, wherein beam intensity remains substantially constant regardless of beam spot size, comprising the steps of:

providing a light source, a lens that can be moved to or between various positions, a slide having positions at which the lens may be supported, a target at which a beam is directed and a controller that communicates between an optical position feedback encoder and the light source;

linking the optical position feedback encoder and the lens, the optical position feedback encoder sending a lens position signal to the controller, the lens signal reporting the position of the lens;

including in the controller an encoder translator circuit which communicates with a microprocessor on which one or more equations are executed, the microprocessor also being configured to receive user inputs that characterize desired beam size at the target;

generating a light source power signal in the microprocessor that is delivered to a power control circuit that is associated with the light source so that electrical power delivered by the light source changes in response to the position of the lens in order to generate a light beam that has a substantially constant intensity regardless of the size of the beam that hits the target location.

2. The method of claim 1, further including the step of communicating a beam size signal (BS) by a user input to the controller and to the microprocessor.

3. The method of claim 2, further including the step of relaying an instruction from the microprocessor to a power control circuit so that a signal (PW) which signifies a power signal is delivered to the light source, that signal informing the light source so that a given power level is determined that causes a beam to be generated that passes through the dynamic lens to the target location, at which beam intensity is substantially constant, regardless of beam size.

4. The method of claim 1, further comprising the steps of:

reporting a desired beam size signal by use input to the controller;

sending desired lens location data to the actuator so that the dynamic lens moves into a position to produce a beam of the required size;

communicating a signal from the optical position feedback encoder to the brightness controller about the position of the dynamic lens as movement occurs, or as movement ends; and processing one or more equations in the microprocessor to calculate the required electrical power level in real time so that the light source maintains a substantially constant intensity over the area of a newly sized beam.

5. The method of claim 1, further comprising the steps of:

observing a desired size of the beam spot;

providing feedback of desired beam size to a control circuit; and computing an amount of intensity adjustment required to maintain a substantially constant actual beam intensity as beam size changes.

6. The method of claim 1 wherein the lens, circuit and light source comprise a subassembly.

7. The method of claim 1, wherein the controller is positioned remotely from the light source.

8. The method of claim 1, further including one or more cooling subsystems in thermal communication with the light source.

9. A system for generating a beam of light that impinges on a target location, wherein beam intensity remains substantially constant regardless of beam spot size, the system comprising:

a light source;

one or more optical control devices such as dynamic optics or lenses that can be moved to or between various positions;

a slide having positions at which the lens can be supported;

a target at which the beam is directed;

an optical position feedback encoder;

a controller that communicates between the optical position feedback encoder and the light source;

a link between the optical position feedback encoder and the lens, the optical position feedback encoder sending a lens position signal to the controller, the lens signal reporting the position of the lens; and an encoder translator circuit in the controller which communicates with a microprocessor on which one or more equations are executed, the microprocessor also being configured to receive user inputs that characterize desired beam size at the target, the microprocessor generating a light source power signal and delivering that signal to a power control circuit that is associated with the light source so that electrical power delivered by the light source changes in response to the position of the lens in order to generate a light beam that has substantially constant intensity regardless of the size of the beam that hits the target location.

10. The system of claim 9, wherein the slide includes an electro-mechanically driven dynamic optic positioner for positioning the lens.

11. The system of claim 10, further including an actuator for moving lens position.

12. A method for generating a beam of light that impinges on a target, wherein beam intensity remains substantially constant regardless of beam spot size, comprising the steps of adjusting lens position to produce a beam of a desired size (BS);

observing lens position by an optical position feedback device;

generating a signal (Lp) that signifies the position of the lens;

transmitting the signal (Lp) to a controller;

generating a power signal (PW); and transmitting that signal (PW) to a light source, thereby adjusting an output of the light source to maintain the desired uniform brightness regardless of spot size (BS).

13. The method of claim 12, further comprising the steps of:

including an optical position encoder in the controller and a microprocessor that executes software which processes an algorithm that computes the power (P) of the light source needed to produce a given beam size according to the following equation:

$$P = \frac{(\pi * r^2)}{(\pi * m^2)} * w * o * s * t,$$

where

P=electrical power r=radius of desired beam size m=radius of maximum beam size w=power at maximum beam diameter o=optical efficiency variable s=source efficiency variable t=temperature coefficient variable.

* * * * *